US009472360B2

(12) United States Patent
Ely

(10) Patent No.: US 9,472,360 B2
(45) Date of Patent: Oct. 18, 2016

(54) CURABLE FOAM SHIMS FOR BUTTONS OF ELECTRONIC DEVICES

(71) Applicant: Apple Inc., Cupertino, CA (US)

(72) Inventor: Colin M. Ely, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 133 days.

(21) Appl. No.: 14/038,806

(22) Filed: Sep. 27, 2013

(65) Prior Publication Data

US 2015/0090576 A1 Apr. 2, 2015

(51) Int. Cl.
*H01H 13/14* (2006.01)
*H01H 13/705* (2006.01)

(52) U.S. Cl.
CPC ..... *H01H 13/705* (2013.01); *H01H 2215/028* (2013.01); *H01H 2221/042* (2013.01); *H01H 2221/084* (2013.01); *H01H 2229/024* (2013.01); *H01H 2229/058* (2013.01); *H01H 2229/064* (2013.01)

(58) Field of Classification Search
CPC ..... H01H 2009/0278; H01H 2213/012; H01H 2221/042; H01H 2221/044; H01H 2221/084; H01H 13/14; H01S 4/00; H01C 1/02; H01C 17/02; B21D 1/00; B21D 3/16; B23P 6/00; H01K 3/22; H01R 43/00; H05B 6/00; H05B 7/00; G01B 15/00; G01B 17/00; G01B 11/00; B29C 39/00; B29C 44/00; B29C 65/00; B29C 51/00; B29C 53/00; B29C 67/20; B29C 35/08; B29C 71/02; B29C 71/04; B27N 3/08; B28B 19/00
USPC ..... 174/50, 50.52, 520, 522, 521, 559, 549, 174/53, 58, 59, 60; 438/106, 36.5, 71, 158, 438/309.9, 310.5, 322.7; 29/592.1, 615, 29/848, 858, 402.21; 264/405–409, 415, 264/41, 46.5, 239, 321, 916, 236, 425; 200/521
See application file for complete search history.

(56) References Cited

U.S. PATENT DOCUMENTS

| | | | | |
|---|---|---|---|---|
| 4,362,911 | A * | 12/1982 | Sears et al. | 200/5 A |
| 4,827,243 | A * | 5/1989 | Cheng | H01H 13/70 200/345 |
| 5,448,028 | A * | 9/1995 | Filion | B60N 2/4693 200/302.1 |
| 2007/0084702 | A1* | 4/2007 | Lin | H01H 13/063 200/5 A |
| 2008/0073186 | A1* | 3/2008 | Kenmochi | 200/5 A |
| 2013/0153006 | A1* | 6/2013 | Cox | H02S 20/00 136/251 |

* cited by examiner

*Primary Examiner* — Renee S Luebke
*Assistant Examiner* — Anthony R. Jimenez
(74) *Attorney, Agent, or Firm* — Brownstein Hyatt Farber Schreck, LLP

(57) ABSTRACT

Button assemblies using curable foam shims are disclosed. A button assembly may include a housing, a button positioned within the housing, and a curable foam shim positioned within the housing, the foam shim transformable between a compressible state having a first thickness, to a rigid state having a second thickness smaller than the first thickness. In this manner, the foam shim can be used to adaptively fill the interior of a button assembly by adapting to the dimensions of various components within the button assembly. In another example, a button assembly is formed using a foam shim by curing from a first state having a first thickness to a second state having a second thickness greater than the first thickness. In this manner, the foam shim can be used to adaptively fill the interior of a button assembly by adapting to the dimensions of various components within the button assembly.

20 Claims, 6 Drawing Sheets

CURABLE FOAM SHIMS FOR BUTTONS OF ELECTRONIC DEVICES

TECHNICAL FIELD

The present disclosure relates generally to buttons of electronic devices, and more particularly relates to shims used in buttons of electronic devices.

BACKGROUND

Electronic devices—such as mobile devices, mobile phones, tablet computers, music and multi-media players, watches, gaming devices, and other handheld, wearable or portable devices—have one or more buttons such as home buttons, power buttons, or buttons that perform other functions.

These buttons typically are formed of multiple components arranged in a button assembly that may include button portion which is depressed by the finger or thumb of a user, and one or more components beneath the button portion. FIG. 1A illustrate an example of a typical button assembly 10 within a housing 12, wherein the button assembly 10 includes a button portion 14. One the opposing end of the button housing 12, a tactile switch 16 may be provided that can contact a flexible circuit portion 20 that can be affixed through a pressure sensitive adhesive (PSA) 21 to a button bracket 22, in this example.

In this example in FIG. 1A, a metal or plastic shim 18 is attached to the interior side of the button portion 14 using a pressure sensitive adhesive.

The shims 18 shown in FIGS. 1A-1C can play an important role in proper tactile feel of a button assembly 10 as experienced by a user—although some buttons can be formed without shims. Typical button click lengths/travel ranges can span from 0.12 mm to 0.28 mm, and shim thicknesses can have tolerances of approximately 0.01 mm in one example.

As recognized by the present inventor, proper tactile feel of a button assembly 10 for user is achieved when, as shown in FIG. 1A, the shim 18 is precisely sized in the gap between the tactile switch 16 and the interior surface of button portion 14—so that there is not excessive play for instance when shim 18 is too thin as shown in FIG. 1B such that the button assembly 10 rattles or feels loose to the user because there is a small gap present between the tactile switch 16 and button portion 14. Conversely, if the shim 18 is too thick as shown in FIG. 1C, then the tactile switch 16 becomes preloaded and the button 14 travel is too short which also is problematic for tactile feel.

As recognized by the present inventor, there are variations in the manufactured thicknesses of each part 12, 14, 16, 20, 22 within a button assembly 10, including variations in the thickness of a conventional plastic shim 18, and these variations can result in either a small gap in the button assembly 10 such as shown in FIG. 1B, or a button tactile switch preload condition in the button assembly 10 such as shown in FIG. 1C.

Accordingly, as recognized by the present inventor, what is needed are improved button shims for buttons of electronic devices.

SUMMARY

According to one broad aspect of one embodiment of the present disclosure, disclosed herein is a button assembly for an electronic device. In one example, the button assembly may include a housing for encasing the button assembly, a button positioned within the housing, and a curable foam shim positioned within the housing, the foam shim transformable between a compressible state to a rigid state. In one example, the foam shim in the compressible state has a first thickness, and when transformed by curing into the rigid state, the foam shim shrinks to a second thickness which is smaller than the first thickness. In this manner, the foam shim can be used to adaptively fill the interior of a button assembly by adapting to the dimensions of various components within the button assembly.

In one example, the foam shim transforms from the compressible state to the rigid state in response ultraviolet curing or curing by heat exposure.

In one example, the position of a curable foam shim may vary. For example, in one embodiment of the present disclosure, a button assembly also includes a button bracket positioned within the housing, a flexible circuit positioned within the housing, and a tactile switch positioned within the housing. The foam shim may be positioned between the button bracket and the flexible circuit; between the flexible circuit and the tactile switch; or between the tactile switch and an interior surface of the button, by way of example.

The button assemblies disclosed herein may be used within a variety of electronic devices, such as mobile devices, mobile phones, tablet computers, music and multi-media players, watches, gaming devices, and other handheld, wearable or portable devices. The button assemblies disclosed herein may be used for numerous purposes, such as but not limited to buttons for power, volume, camera functions, controls, home function, multi-functions, configurable button functions, or any other functions of an electronic device.

According to another broad aspect of another embodiment of the present invention, disclosed herein is a button assembly for an electronic device including a housing for encasing the button assembly; a button positioned within the housing; and a foam shim positioned within the housing, the foam shim transformable by curing from a first state having a first thickness to a second state having a second thickness greater than the first thickness. In this manner, the foam shim can be used to adaptively fill the interior of a button assembly by adapting to the dimensions of various components within the button assembly.

According to another broad aspect of another embodiment of the present invention, disclosed herein is a method of forming a button assembly for use in an electronic device. In one example, the method may include providing a housing for encasing the button assembly; positioning a button within the housing; positioning a curable foam shim within the housing, the foam shim having a first thickness; curing the foam shim, thereby transforming the foam shim from a first state into a rigid second state wherein the foam shim has a second thickness.

In one example, in the first state the foam shim is compressible, and upon curing, the foam shim becomes rigid wherein the second thickness is smaller than the first thickness.

In another example, upon the curing operation, the foam shim expands such that the second thickness is greater than the first thickness.

The curing operation may be ultraviolet curing or curing by heat exposure, in one example.

Other embodiments of the disclosure are described herein. The features, utilities and advantages of various embodiments of this disclosure will be apparent from the following more particular description of embodiments as illustrated in the accompanying drawings.

DETAILED DESCRIPTION

Figure 1A:
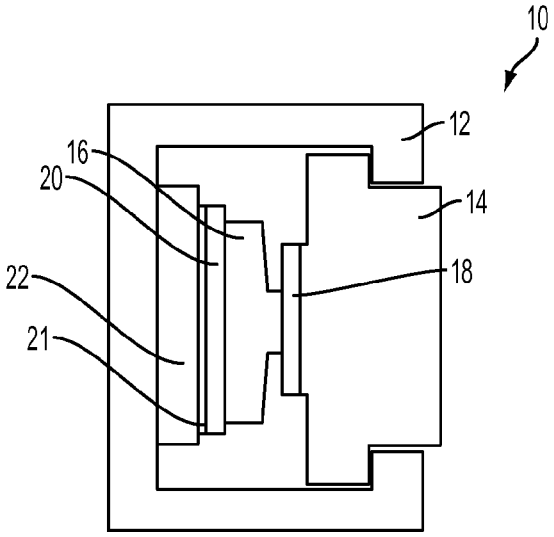
FIGS. 1A-C illustrate examples of a typical button assembly.
Figure 1B:
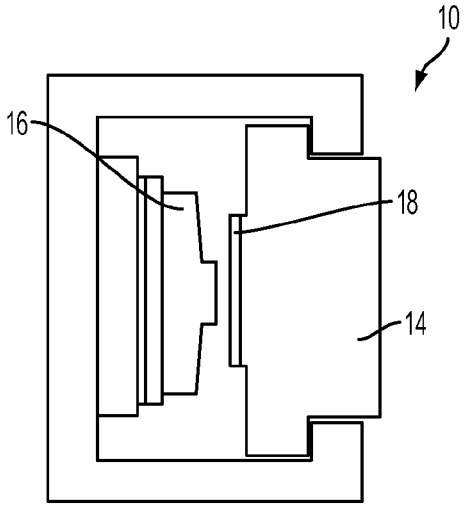
Figure 1C:
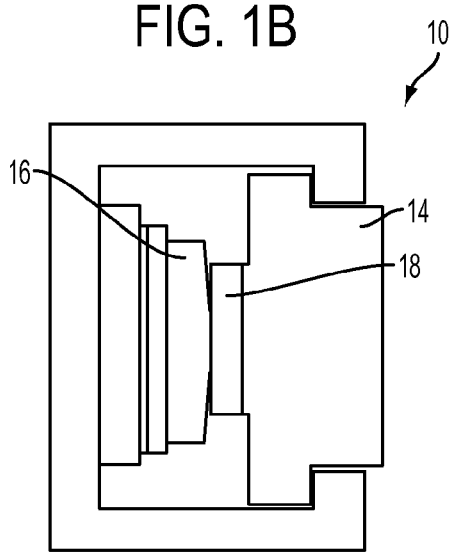

Disclosed herein are various embodiments of foam shims that may be in button assemblies of electronic devices. These foam shims may be used in place of or in combination with conventional shims within any type of button assemblies for electronic devices, such as but not limited to buttons for power, volume, camera functions, controls, home function, multi-functions, configurable button functions, or any other functions of an electronic device.

As described herein, in one example of the disclosure, a button assembly includes a compressible oversized curable foam shim that is positioned within and compressed within the button assembly, which upon curing such as through heat or ultraviolet light, the foam shim becomes rigid with a fixed thickness. In this manner, the foam shim adapts to the precise thickness needed within the button assembly, which aids in providing desired tactile feel of the button for a user.

In another example of the disclosure, a button assembly may include an expandable curable foam shim positioned within the button assembly, which upon curing such as through heat or ultraviolet light while within the button assembly, the foam shim expands and becomes rigid with a fixed thickness. In this manner, the foam shim adapts to the precise thickness needed within a button assembly, which aids in providing desired tactile feel for the button assembly.

Various embodiments of foam shims for use in button assemblies of electronic devices, and related methods, are disclosed herein. The following detailed description refers to the accompanying drawings that depict various details of examples selected to show how particular embodiments may be implemented. The discussion herein addresses various examples of the inventive subject matter at least partially in reference to these drawings and describes the depicted embodiments in sufficient detail to enable those skilled in the art to practice the embodiments. Many other embodiments may be utilized for practicing the subject matter other than the illustrative examples discussed herein, and many structural and operational changes in addition to the alternatives specifically discussed herein may be made without departing from the scope of the disclosed subject matter.

In this description, references to "one embodiment" or "an embodiment," or to "one example" or "an example" mean that the feature being referred to is, or may be, included in at least one embodiment or example of the disclosure. Separate references to "an embodiment" or "one embodiment" or to "one example" or "an example" in this description are not intended to necessarily refer to the same embodiment or example; however, neither are such embodiments mutually exclusive, unless so stated or as will be readily apparent to those of ordinary skill in the art having the benefit of this disclosure. Thus, the present disclosure includes a variety of combinations and/or integrations of the embodiments and examples described herein, as well as further embodiments and examples as defined within the scope of all claims based on this disclosure, as well as all legal equivalents of such claims.

Figure 2:
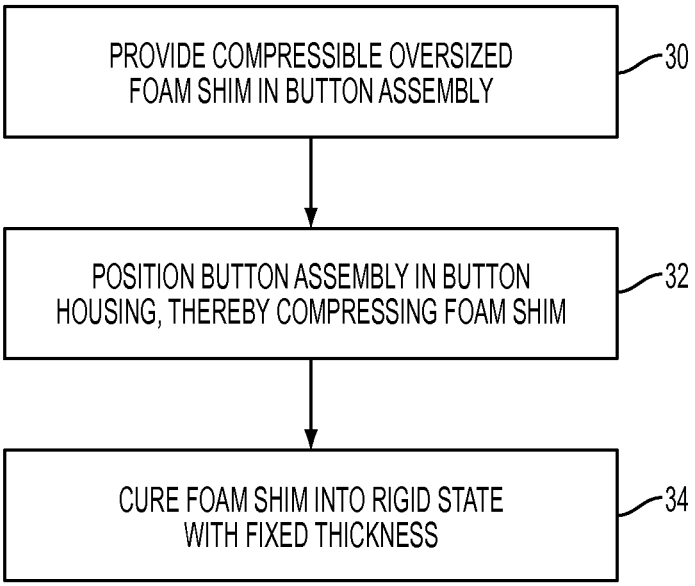
FIG. 2 illustrates an example of a process for forming a button of electronic device using a compressible foam shim, in accordance with one embodiment of the present disclosure.
Figure 3A:
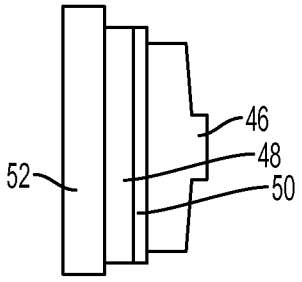
FIGS. 3A-C illustrate an example of a button of electronic device using a compressible foam shim, in accordance with one embodiment of the present disclosure.
Figure 3B:
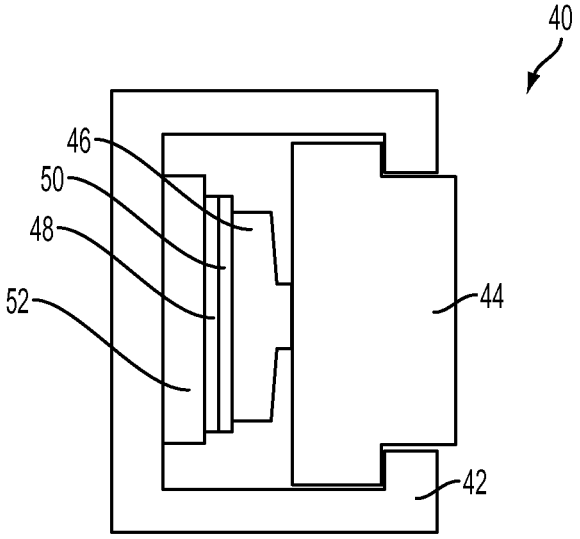
Figure 3C:
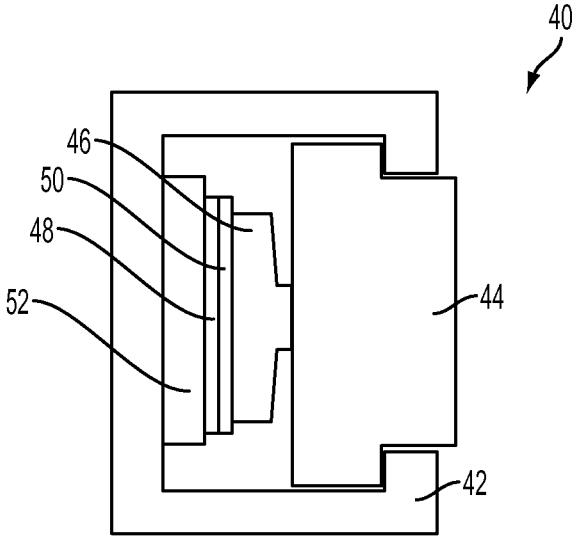

Referring to FIG. 2 and FIGS. 3A-C, an example of a process for forming a button assembly of electronic device (such as device 38 in FIG. 6) using a compressible foam shim is illustrated in accordance with one embodiment of the present disclosure. FIGS. 3A-C illustrate an example of a button assembly of electronic device (such as device 38 in FIG. 6) using a compressible foam shim, in accordance with one embodiment of the present disclosure.

Figure 6:
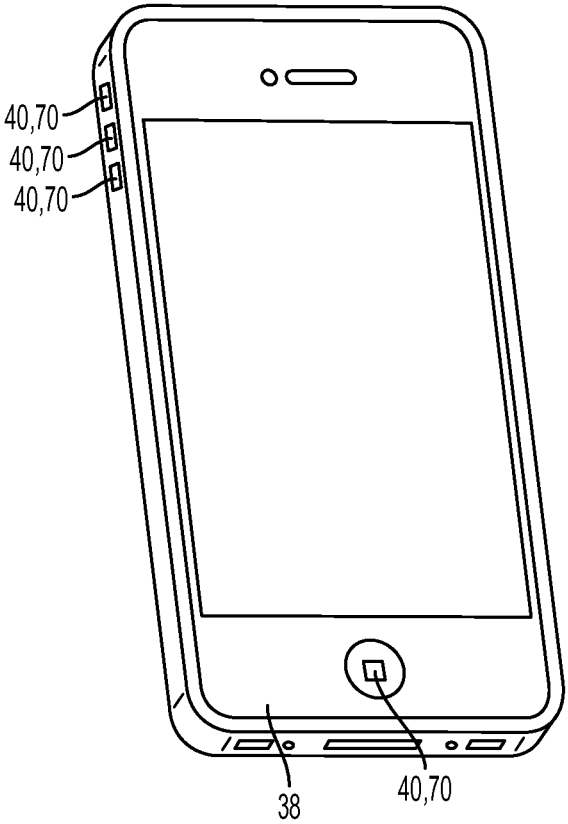
FIG. 6 illustrates an example of an electronic device, having a plurality of buttons which may be formed using foam shims, in accordance with an embodiment of the present disclosure.

In FIG. 2, at operation 30, compressible foam shim (which may be oversized) is provided in a button assembly. One example of this operation 30 is shown in FIGS. 3A-B, wherein a button assembly 40 is formed having a housing 42, a button 44, a tactile switch 46, and foam shim 48 having an initial thickness. In one example of a button assembly 40, flexible circuit 50 and a button bracket 52 may also be included in the button assembly, but each are optional depending on the implementation. The foam shim 48, in one example may be positioned between the tactile switch 46, flexible circuit 50, and button bracket 52, or may be positioned in other locations within the button assembly 40. The button assembly 40 can be used in or as part of an electronic device 38 (FIG. 6).

At operation 32 of FIG. 2, the button assembly is positioned within a button housing, thereby compressing the foam shim. One example of this operation 32 is shown in FIGS. 3A-B, wherein once the subassembly of the tactile switch 46, optional flexible circuit 50, the foam shim 48 and optional button bracket 52, is inserted within button housing 42, the foam shim 48 is compressed to a second, smaller thickness (when compared to the initial thickness of FIG. 3A) when button 24 in its normally open switch position, as shown in FIG. 3B. The initial thickness of the foam shim 48 may be selected in an oversized dimension such that when the foam shim 48 and the other components (i.e., 44, 46, 50, 52) of the button assembly are positioned within the housing 42, the foam shim 48 compresses and there is no gap present between the components of the button assembly within the housing 42.

At operation 34 of FIG. 2, the foam shim within the button housing is cured, which thereby transforms the foam shim into a rigid state wherein the foam shim has a fixed, static thickness. The curing operation 34 may be achieved using heat curing or ultraviolet light curing, depending upon the implementation.

One example of this operation 34 is illustrated in FIG. 3C, wherein the foam shim 48 is cured into a fixed, static thickness which is the thickness of the foam shim 28 established when the foam shim 48 is compressed by the dimensions of the components 44, 46, 50, 52 when positioned within housing 42; this thickness of the foam shim 48 in FIG. 3B-3C is smaller than the initial thickness of shim 48 in FIG. 3A. Once the curing operation 34 is complete, the foam shim 48 does not further compress or otherwise change in thickness and exhibits a rigid, static and fixed thickness for the life of the shim 48 in the button assembly 40. In this manner, foam shim 48 provides the precise amount of shim thickness to aid in providing a proper tactile feel of the button assembly 40 of FIG. 3C.

Figure 4:
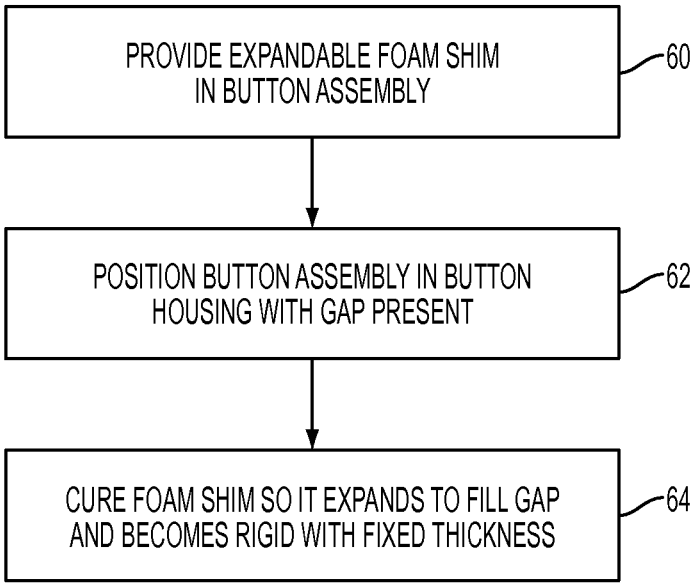
FIG. 4 illustrates an example of a process for forming a button of electronic device using an expandable foam shim, in accordance with one embodiment of the present disclosure.
Figure 5A:
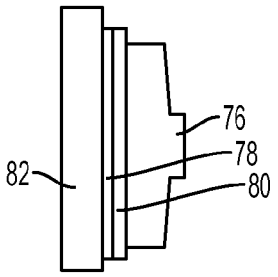
FIGS. 5A-C illustrate an example of a button of electronic device using an expandable foam shim, in accordance with one embodiment of the present disclosure.
Figure 5B:
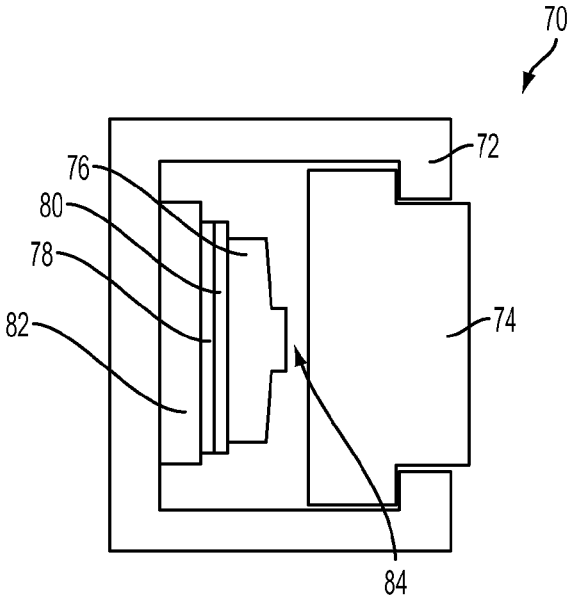
Figure 5C:
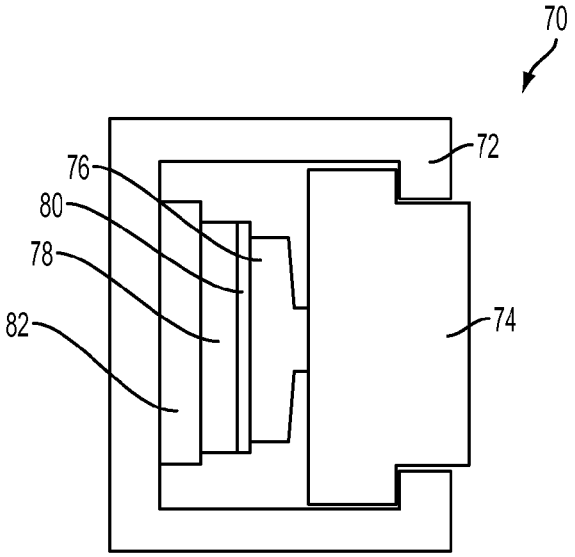

Referring to FIG. 4 and FIGS. 5A-C, an example of a process for forming a button of electronic device using an expandable foam shim is illustrated in accordance with another embodiment of the present disclosure. FIGS. 5A-C illustrate an example of a button assembly 70 of electronic device 38 using an expandable foam shim 78, in accordance with one embodiment of the present disclosure.

In FIG. 4, at operation 60, an expandable foam shim is provided in a button assembly. One example of this operation 60 is shown in FIGS. 5A-B, wherein a button assembly 70 is formed having a housing 72, a button 74, a tactile switch 76, an expandable foam shim 78 having an initial thickness. A flexible circuit 80 and a button bracket 82 may also be included in the button assembly 70, but each are optional depending upon the particular implementation.

The expandable foam shim 78 may be positioned between the tactile switch 76, optional flexible circuit 80, and optional button bracket 82 in one example. The expandable foam shim 78 may have a thickness that increases in response to ultraviolet light curing or heat curing, in one example.

At operation 62 of FIG. 4, the button assembly is positioned within a button housing, wherein in one example of this operation 42, a gap may be present within the button assembly. One example of this operation 62 is shown in FIGS. 5A-B, wherein once the subassembly of the tactile switch 76, optional flexible circuit 80, foam shim 78 and optional button bracket 82, is inserted within button housing 72, a gap 84 can be present between the button 74 and the tactile switch 76. In FIGS. 5A-B, foam shim 78 has an initial thickness.

The initial thickness of the foam shim 78 may be selected in an undersized dimension such that when the foam shim 78 and the other components (i.e., 74, 76, 80, 82) of the button assembly 70 are positioned within the housing 72, there is a gap 84 present between the components of the button assembly within the housing 72.

At operation 64 of FIG. 4, the foam shim within the button housing is cured, which thereby expands the thickness of the foam shim to fill the gap established at operation 62 until the foam shim cannot further expand, at which point the foam shim enters a rigid state wherein the foam shim has a fixed, static thickness. The curing operation 64 may be achieved using heat curing or ultraviolet light curing, depending upon the implementation.

One example of operation 64 is illustrated in FIG. 5C, wherein the foam shim 78 expands from its initial thickness (shown in FIGS. 5A-5B) to a second, enlarged thickness (shown in FIG. 5C) which is greater than the initial thickness of FIGS. 5A-5B and which fills the gap 84 in FIG. 5B. In FIG. 5C, the foam shim 78 has completed its expansion in response to curing operation 64, and foam shim 78 has a fixed, static thickness which is the thickness of the foam shim 78 as shown in FIG. 5C. Once the curing operation 64 is complete, the foam shim 78 does not further expand, compress or otherwise change in thickness and exhibits a rigid, static and fixed thickness for the life of the shim 78 in button assembly 50. In this manner, foam shim 78 provides the precise amount of shim thickness to aid in providing a proper tactile feel of the button assembly 70 of FIG. 5C.

In both FIGS. 3A-C and 5A-C, foam shims 48, 78 are shown positioned between the optional button brackets 52, 82 and optional flexible circuits 50, 80. In another embodiment, foam shims 48, 78 can be positioned within other locations or between other components within the button assemblies 40, 70. For instance, as an example, foam shims 48, 78 may be positioned between flex circuits 50, 80 and tactile switches 46, 76. As another example, foam shims 48, 78 may be positioned between tactile switches 46, 76 and the interior surface of buttons 44, 74.

In another example of an embodiment of this disclosure, a button can be formed without flexible circuits and without button brackets. For instance, a button could be formed with a button housing, a button, a tactile switch, and a foam shim positioned within the button housing, wherein the foam shim fills any gap that would otherwise exist within the button assembly. In one example, such a button could be mounted to a circuit board or other electronic device or component thereof.

In another embodiment, a laser welded bracket could be used in a button assembly instead of an expandable/curable shim. For instance, in one example, two stamped sheet metal parts could have a slight spring between them, and could be positioned within a button assembly to take up or fill any gap that exists within the button assembly. The sheet metal parts could be laser welded together to form a bracket that provides a strong structure inside the button assembly, which can thereby fill gaps between button components within the button assembly to provide desired tactile feel for the button.

The buttons 44, 74 can be formed using any desired top surface shape or configuration, depending upon the implementation, in order to engage a user's finger or thumb during use. For instance, the top surface of buttons 44, 74 can shaped in configurations such as round, oval, square, rectangular, or any other shape as desired. In the example electronic device 38 of FIG. 6, button assemblies 40, 70 include round buttons and rectangular buttons, by way of example only.

FIG. 6 illustrates an example of an electronic device 38, having a plurality of buttons which can include button assemblies 40, 70 formed using foam shim 48, 78. In this example, the electronic device 38 is in the form of a mobile phone having button assemblies 40, 70 having foam shims therein. It is understood that embodiments of the present disclosure can be used within a variety of electronic devices, such as but not limited to mobile devices, mobile phones, tablet computers, music and multi-media players, watches, gaming devices, and other handheld, wearable or portable devices.

Accordingly, it can be seen that embodiments of the present disclosure provide for curable foam shims that may be used within button assemblies of electronic devices, in order to aid in providing desired tactile feel of such button assemblies to users of the electronic devices.

While the methods disclosed herein have been described and shown with reference to particular operations performed in a particular order, it will be understood that these operations may be combined, sub-divided, or re-ordered to form equivalent methods without departing from the teachings of the present disclosure. Accordingly, unless specifically indicated herein, the order and grouping of the operations is not a limitation of the present disclosure.

It should be appreciated that in the foregoing description of exemplary embodiments of the disclosure, various features of the disclosure are sometimes grouped together in a single embodiment, figure, or description thereof for the purpose of streamlining the disclosure and aiding in the understanding of one or more of the various aspects. This method of disclosure, however, is not to be interpreted as reflecting an intention that an embodiment requires more features than are expressly recited in each claim. Rather, inventive aspects lie in less than all features of a single foregoing disclosed embodiment, and each embodiment described herein may contain more than one inventive feature.

It will be understood by those skilled in the art that various changes in the form and details may be made from the embodiments shown and described without departing from the spirit and scope of the disclosure.

I claim:

1. A button assembly for an electronic device, comprising:
a housing;
a button positioned within the housing;
a tactile switch positioned within the housing; and
a foam shim positioned within the housing, the foam shim having been transformed from a compressible state to a rigid state by curing the foam shim.

2. The button assembly of claim 1, further comprising:
a button bracket positioned within the housing; and
a flexible circuit positioned within the housing.

3. The button assembly of claim 1, wherein:
the foam shim has been compressed to a thickness prior to being transformed from the compressible state; and
the foam shim in the rigid state has substantially the same thickness as the compressed foam shim.

4. The button assembly of claim 1, wherein the curing comprises ultraviolet curing.

5. The button assembly of claim 1, wherein the curing comprises heat curing.

6. The button assembly of claim 2, wherein the foam shim is positioned between the button bracket and the flexible circuit.

7. The button assembly of claim 2, wherein the foam shim is positioned between the flexible circuit and the tactile switch.

8. The button assembly of claim 1, wherein the foam shim is positioned between the tactile switch and an interior surface of the button.

9. The button assembly of claim 1, wherein the electronic device is a mobile phone.

10. A button assembly for an electronic device, comprising:
a housing;
a button positioned within the housing;
a tactile switch positioned within the housing; and
a foam shim positioned within the housing, the foam shim having been transformed from a first state having a first thickness, to a rigid second state having a second thickness greater than the first thickness.

11. The button assembly of claim 10, further comprising:
a button bracket positioned within the housing; and
a flexible circuit positioned within the housing.

12. The button assembly of claim 10, wherein the foam shim transforms from the first state to the second state in response ultraviolet curing.

13. The button assembly of claim 10, wherein the foam shim transforms from the first state to the second state in response heat curing.

14. The button assembly of claim 10, wherein when in the second state, the foam shim becomes rigid.

15. The button assembly of claim 11, wherein the foam shim is positioned between the button bracket and the flexible circuit.

16. The button assembly of claim 10, wherein the foam shim is positioned between the tactile switch and an interior surface of the button.

17. A button stack for an electronic device, comprising:
a tactile switch;
a button member configured to actuate the tactile switch; and
a foam shim filling a gap in the button stack, the foam shim having been transformed from an at least partially compressed state to a rigid state in which the foam shim has substantially a same thickness as the foam shim in the at least partially compressed state.

18. The button stack of claim 17, wherein the foam shim has been transformed from the at least partially compressed state to the rigid state by heat curing, ultraviolet curing, or both.

19. The button stack of claim 17, further comprising a button bracket, wherein the foam shim is disposed between the tactile switch and the button bracket.

20. The button stack of claim 17, wherein the foam shim is configured to resist deformation in response to force applied to the button member.

* * * * *